United States Patent [19]

Beneke et al.

[11] 4,196,497

[45] Apr. 8, 1980

[54] VACUUMING APPARATUS FOR CARDING MACHINES TO CLEAN THE MOVING COVER

[75] Inventors: Wolfgang Beneke; Jürgen Klüttermann; Paul G. Teichmann, all of Mönchengladbach, Fed. Rep. of Germany

[73] Assignee: Trutzschler GmbH & Co. KG, Monchengladbach, Fed. Rep. of Germany

[21] Appl. No.: 924,083

[22] Filed: Jul. 12, 1978

[30] Foreign Application Priority Data

Jul. 23, 1977 [DE] Fed. Rep. of Germany ..... 2733421

[51] Int. Cl.[2] ..... D01G 15/76; D01G 15/75

[52] U.S. Cl. ..... 19/107; 19/110

[58] Field of Search ..... 19/107, 110, 111, 102

[56] References Cited

U.S. PATENT DOCUMENTS 3,678,538 7/1972 Sloan ..... 19/107

FOREIGN PATENT DOCUMENTS 470498 5/1969 Switzerland ..... 19/107

1038426 8/1966 United Kingdom ..... 19/107

1098949 1/1968 United Kingdom ..... 19/107

*Primary Examiner*—Louis Rimrodt

*Attorney, Agent, or Firm*—Haseltine, Lake & Waters

[57] ABSTRACT

A vacuuming device for carding equipment for cleaning the revolving flats in which a vacuuming box is located between a licker-in and the adjacent flats deflection roller. The vacuuming box is enclosed on all sides. The region of the flats deflection roller on the inside of the revolving flats, accommodates a guide element for diverting dust-laden air in the direction of at least one intake opening in the vacuuming box. This intake opening is associated with the revolving flats. The guide element may be made hollow to receive dust-laden air, and may be connected in a sealing manner with the revolving flats. The vacuuming box may have two intake openings which are placed so that one of these openings always faces an open gap between the revolving flats. The intake openings may be in the form of slots extending throughout the width of the card. A layer for sealing off the revolving flats, may be made of soft material and may be located on the vacuuming box in front of the intake openings.

7 Claims, 2 Drawing Figures

VACUUMING APPARATUS FOR CARDING MACHINES TO CLEAN THE MOVING COVER

BACKGROUND OF THE INVENTION

The present invention relates to a vacuuming device for carding equipment for cleaning the revolving flats, in which a vacuuming box, enclosed on all sides, is located between the intake piece and the adjacent flats deflection roller.

With a known vacuuming apparatus, a guard sheet is located between the vacuuming box and the carding assortment. The air channel formed in the peripheral direction of the drum extends with its exit end to the vicinity of the flats deflection roller. The dust-laden air carried along by the drum exits at this exit end and passes through the spaces between the covers into the inside space of the flats deflection roller. The dust particles and fibers carried by the air are deposited on and between the covers and in the inside space. With this known vacuuming apparatus, the vacuuming box does not fully occupy the space between the intake piece and the flats deflection roller. The suction opening for the entry of air and the particles carried by it, such as loose fibers, dust, etc. is located at the lower end of the side wall of the suction channel and directly faces the gap between the guard sheets of the licker-in and the drum. This embodiment has the disadvantage that the suction action is not sufficient to thoroughly clean the space left open by the vacuuming box and the entire inside space in the vicinity of the flat deflection roller. In particular, the suction force is not sufficient to clean the covers and the spaces between the covers and to remove dust and fiber particles.

Accordingly, it is the object of the present invention to provide a vacuuming apparatus which avoids these disadvantages and permits an effective vacuuming and cleaning of the revolving flats.

Another object of the present invention is to provide vacuuming apparatus of the foregoing character which is substantially simple in construction and may be economically fabricated.

A further object of the present invention is to provide vacuuming apparatus as described, which may be easily maintained in service and which has a substantially long operating life.

SUMMARY OF THE INVENTION

The objects of the present invention are achieved by providing a vacuuming box, enclosed on all sides, between the licker-in and the adjacent flats deflection roller. A guide element is located in the region of the flats deflection roller on the inside of flats facing away from the flats carding surface. This guide element diverts dust-laden air in the direction of at least one intake opening in the vacuuming box. This opening is associated with the cover bar.

The guide element may be constructed as a hollow member for receiving dust-laden air, and may be connected in a sealing manner with the revolving flats.

The vacuuming box may have two intake openings which are associated with the revolving flats, and which may be placed in a manner such that one of the two intake openings always faces an open gap between the revolving flats. The intake openings may be in the form of slots extending throughout the width of the carding drum.

A layer for sealing the revolving flats may be made of soft material and located on the vacuuming box in front of the intake openings.

On the inside of the revolving flats is the guide element which covers the region between the intake and exit of the dust-laden air through the spaces between flats. This considerably reduces the inside space in the region of the flats deflection roller into which dust-laden air gets. This guide element is preferably hollow, e.g., concave, and thus can effectively receive the dust-laden air and deflect it in the direction of the vacuuming box. Also, the vacuuming box has at least one intake opening associated with the revolving flats, i.e., is located at the upper end of the side wall of the vacuuming box. Because the region to be vacuumed is bounded by the guide element and the intake opening is located near this region, effective cleaning of the spaces between the revolving flats and of the revolving flats themselves is accomplished simply with the suction air flow available. Another advantage is that an overpressure forms inside the guide element which is released as cleaning air current through the space between the cover bars during movement of the moving cover.

To achieve effective sealing, the guide element is connected to the chain of revolving flats in a sealing manner.

In a preferred embodiment, the vacuuming box has two intake openings associated with the revolving flats. These intake openings are placed so that an open gap between the revolving flats faces one of the two intake openings. If, for example, one of the intake openings faces a flat and thus closes this intake opening, the other intake opening should be opposite the space between two flats. If the moving cover travels further, the intake opening alternately faces a flat or a space. This results in an intermittent suction flow. The dust-laden air collecting in the guide element is alternately under overpressure; the suction air current is reinforced by the pressure of this dust-laden air, so that the spaces between the flats are cleaned in spurts. The intake openings extend over the width of the carding drum and are made as full length slots so that the air and the particles carried along by it are carried with minimum resistance and correspondingly low pressure drop.

The novel features which are considered as characteristics for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
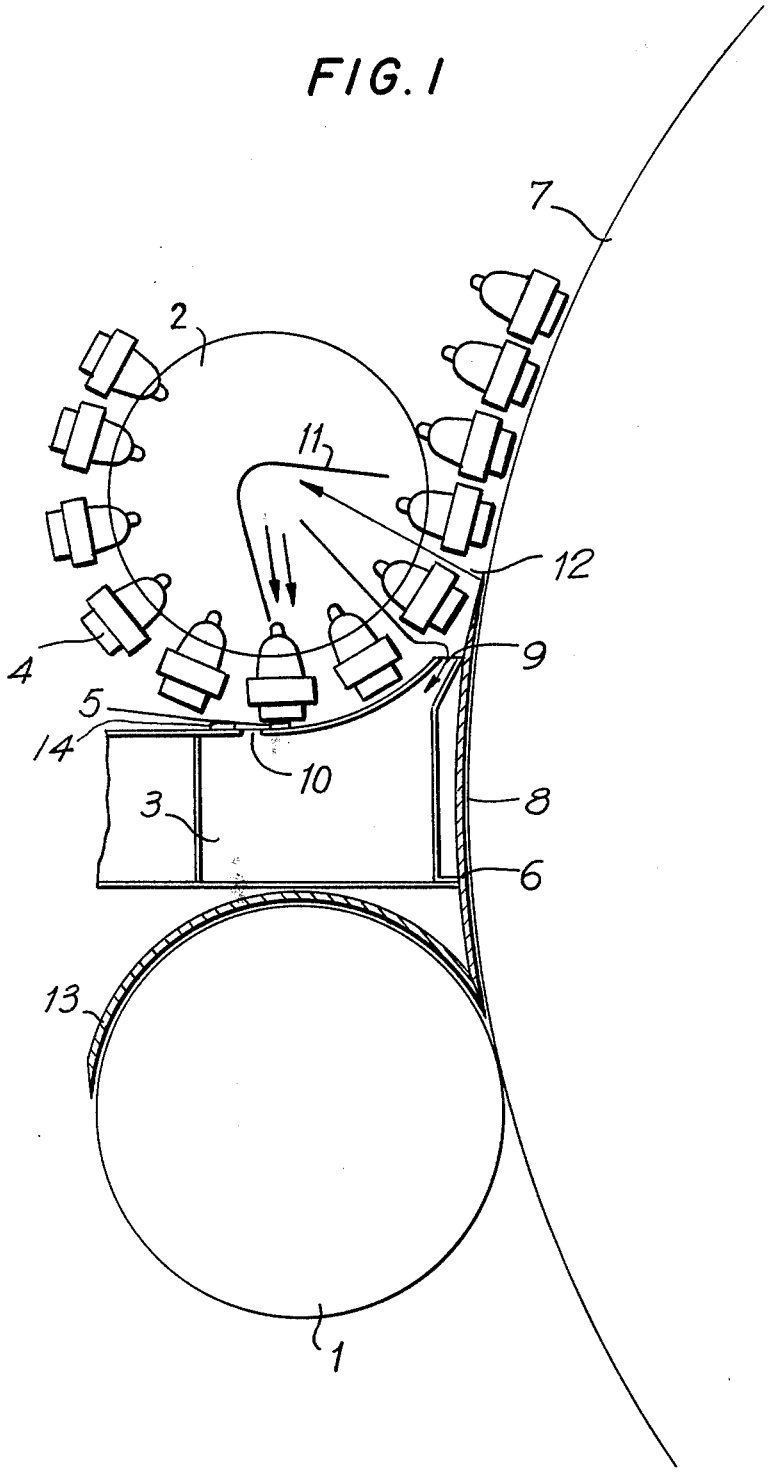
FIG. 1 shows a side view of a vacuuming apparatus in accordance with the present invention.

A vacuuming box 3 is located between the licker-in 1 and the flats deflection roller 2. The vacuuming box 3 fills this space in such a way that a vacuuming channel 5 extends between the wall of vacuuming box 3 facing the flats deflection roller 2 and the revolving flats 4. This vacuuming channel 5 follows the curvature of the revolving flats deflection roller 2. The vacuuming box 3 wall facing the guard sheet 6 of drum 7 extends close to the guard sheet 6. Between guard 6 and drum 7 is an air channel 8 whose exit end 12 extends into the vicinity of the revolving flats 4. At the upper end of the vacuuming box 3 wall, facing the guard sheet 6, is an intake opening 9 which is opposite the gap between the vacuuming channel 5 and the guard sheet 6. Furthermore, in the vicinity of the vacuuming box 3 wall facing the flats 4, another intake opening 10 is located. On the inside of the flats 4, facing away from the flats carding surface, a concavely bent guide element 11 is located. One limiting edge of this guide element 11 is associated with the exit end 12 in such a way that air flowing into the inside space between the revolving flats 4 comes in contact with the inside wall of the guide element 11. The other limiting edge of the guide element 11 is associated with the intake opening 10 of the vacuuming box.

In operaton, the dust-laden air pulled along by the drum 7 exits at the exit end 12 of the air channel 8. Part of this air is sucked into the intake opening 9 of vacuuming box 3. The other part of this air flows through the space between the adjacent revolving flats 4 into the inside space of guide element 11. In this position, intake opening 10 of vacuuming box 3 faces a flat 4 so that intake opening 10 is substantially closed. If the revolving flats is moved further (see FIG. 2), the intake opening 10 faces a flat 4 so that the exit end 12 is substantially closed while the intake opening faces a space between two revolving flats 4. In this position, the dust-laden air from one guide element 11 is sucked through the spaces between the flats 4 partially through suction channel 5 into the intake opening 10 of the vacuuming box 3. Since a suction channel 5 extends between the flats 4 and the vacuuming box 3 and an underpressure is continuously applied to the intake openings 9 and 10, air is continuously sucked through intake openings 9 and 10, independent of the intermittent air current described.

Figure 2:
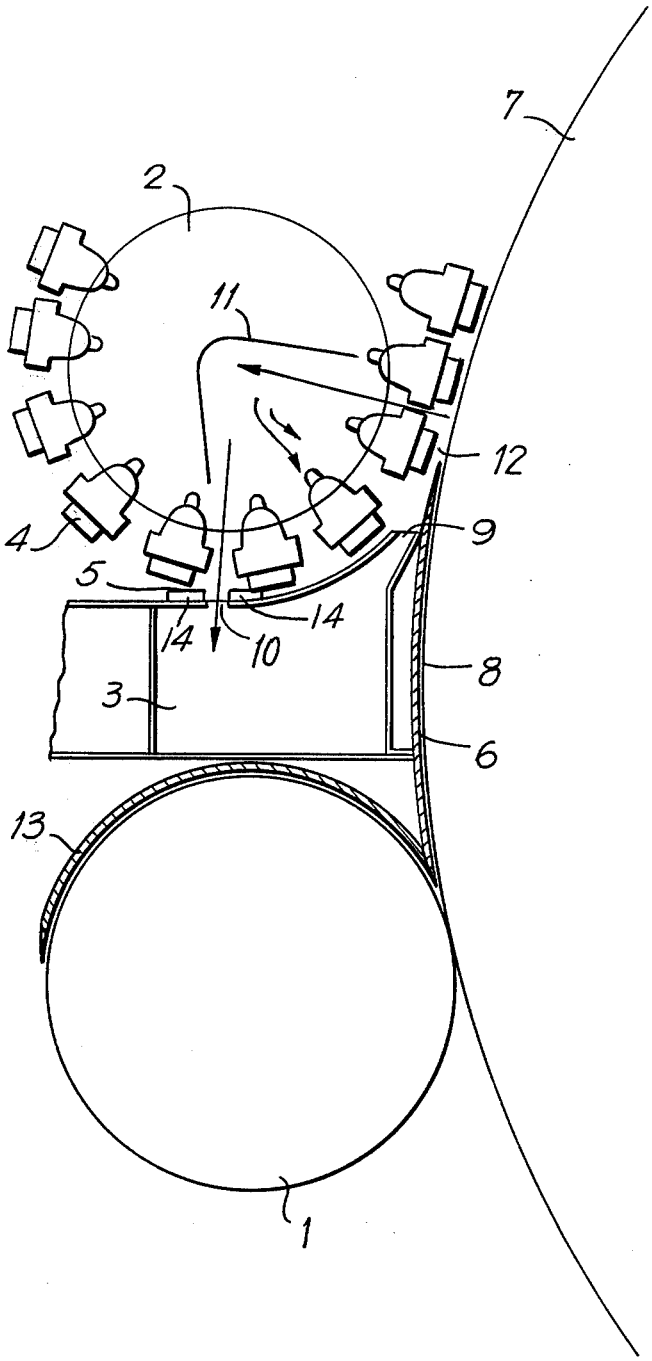
FIG. 2 shows the vacuuming apparatus of FIG. 1, but with another position of the flats.

In the embodiment shown in FIGS. 1 and 2, a layer 14 sealing the flats' carding surface of flats 4 may be provided on the vacuuming box 3 in front of the intake opening 10. This layer 14 may have the form of a strip or a coating and is made of soft material, e.g., polyethylene, in order to protect the flats' carding surface. Hence outside air can enter only through the flats' carding surface so that the flats' carding surface is cleaned of dust.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What we claim is:

1. A vacuuming device with revolving flats for carding equipment for cleaning the revolving flats comprising: a licker-in; a flats deflection roller adjacent to said licker-in; a vacuuming box located between said licker-in and said flats deflection roller and being enclosed on all sides; said vacuuming box having at least two intake openings for dust-laden air, said intake openings being associated with said revolving flats; and a guide element located inside said flats deflection roller for diverting dust-laden air towards one of said intake openings.

2. A vacuuming device as defined in claim 1 wherein said guide element comprises a hollow member for receiving dust-laden air.

3. A vacuuming device as defined in claim 1 wherein said guide element is connected sealingly with said (cover bars.) revolving flats.

4. A vacuuming device as defined in claim 1 wherein revolving flats are spaced apart with open gaps, said intake openings being located so that one of said two intake openings always faces an open gap between said revolving flats.

5. A vacuuming device as defined in claim 1 wherein said intake openings comprise slots extending throughout the width of a carding drum.

6. A vacuuming device as defined in claim 1 including a layer of substantially soft material located on said vacuuming box in front of said intake opening for sealing the revolving flats.

7. A vacuuming device as defined in claim 1 wherein said intake openings are associated with said revolving flats so that one of said intake openings always faces an open gap between two revolving flats when said revolving flats are in motion.

* * * * *